US008590721B2

(12) United States Patent
Pasi

(10) Patent No.: US 8,590,721 B2
(45) Date of Patent: Nov. 26, 2013

(54) DEVICE IN CONNECTION WITH SMALL ARTICLES

(76) Inventor: Leskinen Pasi, Espoo (FI)

( * ) Notice: Subject to any disclaimer, the term of this patent is extended or adjusted under 35 U.S.C. 154(b) by 153 days.

(21) Appl. No.: 12/451,988

(22) PCT Filed: Aug. 13, 2008

(86) PCT No.: PCT/FI2008/050458
§ 371 (c)(1),
(2), (4) Date: Feb. 2, 2010

(87) PCT Pub. No.: WO2009/022058
PCT Pub. Date: Feb. 19, 2009

(65) Prior Publication Data

US 2010/0147839 A1 Jun. 17, 2010

(30) Foreign Application Priority Data

Aug. 14, 2007 (FI) ..... 20070613

(51) Int. Cl.
*B65D 5/64* (2006.01)

(52) U.S. Cl.
USPC ..... 220/6

(58) Field of Classification Search
USPC ..... 220/6; 206/586, 493; 273/285; 446/268; 112/183; 229/183, 122, 123, 130
See application file for complete search history.

(56) References Cited

U.S. PATENT DOCUMENTS

| | | | | |
|---|---|---|---|---|
| 1,451,468 | A * | 4/1923 | Olshan | 220/6 |
| 2,582,575 | A * | 1/1952 | Young | 434/419 |
| 2,758,774 | A * | 8/1956 | Grunert et al. | 229/117.07 |
| 3,955,677 | A * | 5/1976 | Collingwood | 206/453 |
| 6,203,017 | B1 | 3/2001 | Schultz | |
| 6,915,603 | B2 * | 7/2005 | Hunt | 40/312 |
| 2005/0153625 | A1 | 7/2005 | Wigo | |
| 2006/0213807 | A1 | 9/2006 | Sonon | |

* cited by examiner

*Primary Examiner* — Anthony Stashick
*Assistant Examiner* — Kevin Castillo
(74) *Attorney, Agent, or Firm* — Skinner and Associates

(57) ABSTRACT

Device in connection with small articles, for example, building blocks, and comprising an essentially box-like (1) construction, in which at least one side of the box, for example, the cover (2), is formed of at least two parts (21, 22) folded on top of each other, which can be spread to form a totality in essentially the direction of the base. The side wall (24) of the box can also be turned in essentially the direction of the base, in which case the said parts (21, 22) folded on top of each other are joined to form a continuation of the wall (24).

6 Claims, 4 Drawing Sheets

A – A

DEVICE IN CONNECTION WITH SMALL ARTICLES

The present invention relates to a device in connection with small articles. More specifically, it relates to a storage and use means for many different kinds of small article, and also, if necessary, a base for games, etc.

In many situations in different connections, different kinds of small article are stored in various kinds of jars and boxes, from which it is difficult to search for a suitable item. This means that the usual operation is to pour the contents of the jar or box onto the floor, so that the item being sought can be found more easily, but gathering the articles back into the jar or similar is extremely labourious.

The aforementioned problems also concern certain articles used in games, a specific example of which is the various building blocks sold under the LEGO trademark, some of which are quite small so that there must be a relatively large selection of them in quantity for building to become as diverse as intended.

Gathering the aforementioned blocks from the floor after play is a stage in children's play that every parent has experienced. Everyone who has experienced it will also understand why acquiring a means that would facilitate the gathering of the blocks after a children's game would be a very welcome aid to the said work.

The present invention is intended to create a device, with the aid of which the storage and use events of small articles will be an obvious improvement over known ways, thus facilitating the task and bringing new dimensions to it.

The aforementioned and other benefits and advantages of the present invention are achieved in the manner described as characteristic in the accompanying claims.

In the following, one embodiment of the invention is examined in greater detail with reference to the accompanying drawings, which show one practical and well regarded construction of the device according to the invention.

Thus:

Figure 4:
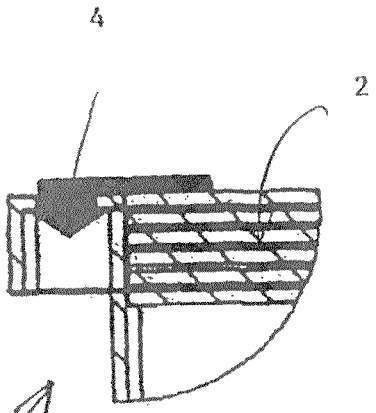
Figure 3:
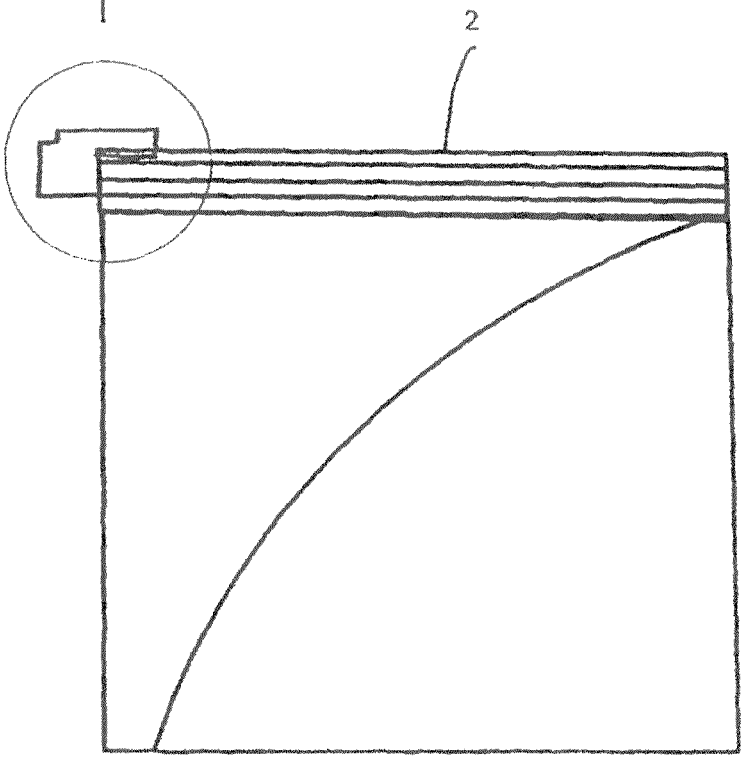
FIG. 3 shows cross-section A-A of FIG. 2.
Figure 5:
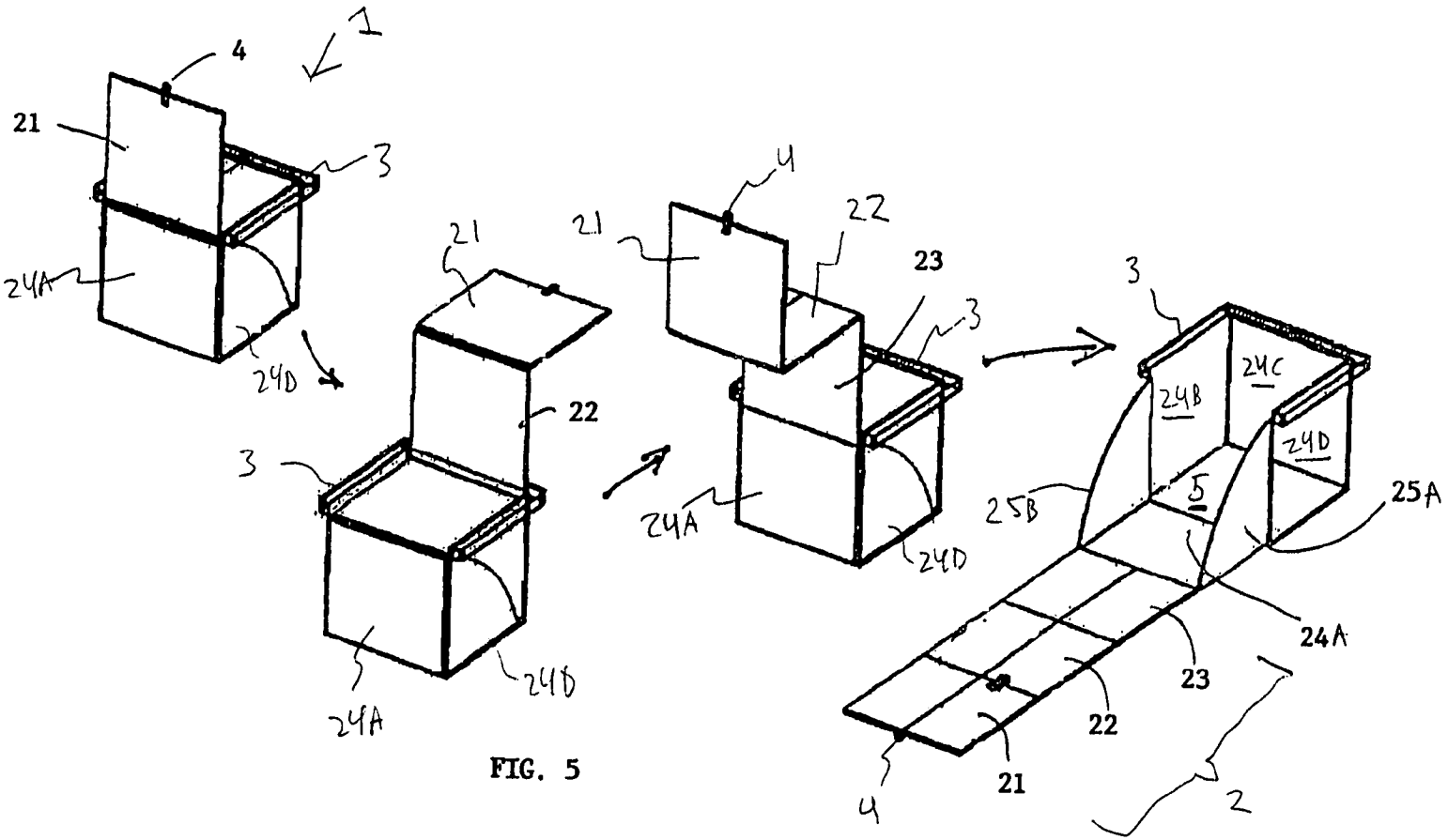
Figure 6:
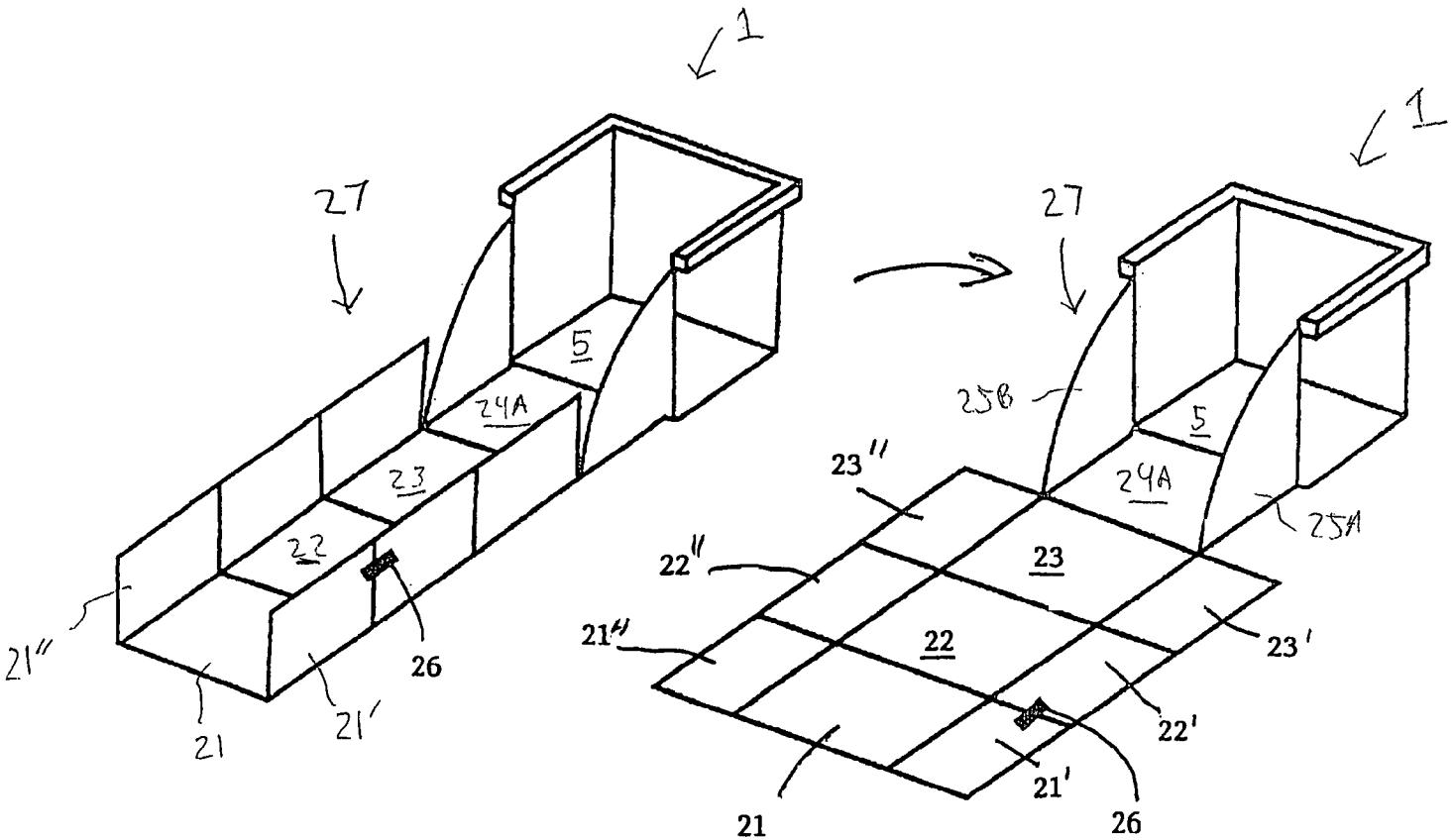

FIG. 4, for its part, shows the detail marked in FIG. 3, at a larger scale;

FIG. 5 shows the initial stages of preparing the device according to the invention; and FIG. 6 shows the final stages of preparing the device for use.

Figure 1:
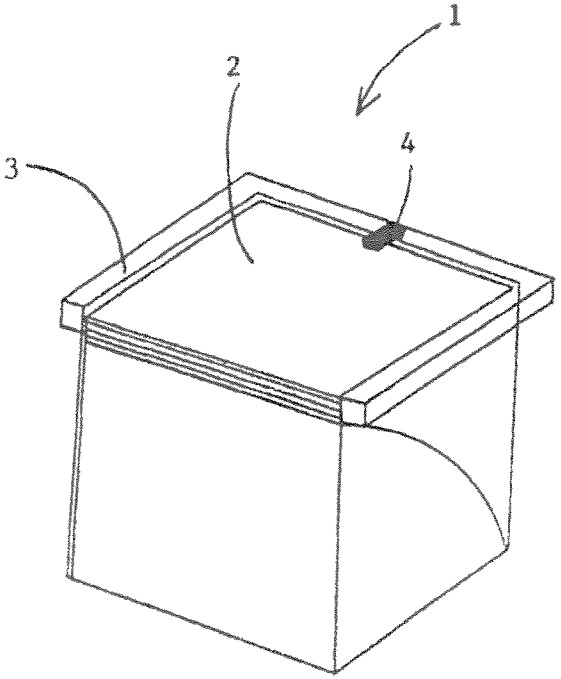
FIG. 1 shows an example of the device according to the invention, seen at an angle.

As can be clearly seen from FIG. 1, the device 1 according to the invention is essentially a box-like structure. The situation shown in FIG. 1 is the so-called not-in-use situation, in which the small articles have been gathered inside the box, where they can be neatly stored. In this situation, the box 1 is closed and has four walls 24 A, B, C and d, a roof 2, and a base 5. A suitable reinforcement 3 runs around three sides of the upper edge of the box 1. The roof or cover 2, the construction of which is described later in greater detail, is secured in the closed position with the aid of a suitable securement means 4.

The reinforcement 3 is only one possibility. The use or otherwise of a reinforcement is always case-specific. Sometimes some kind of reinforcement, i.e. something very different to that shown in the figure, is necessary, but it can also be omitted depending, for example, on the choice of material.

Figure 2:
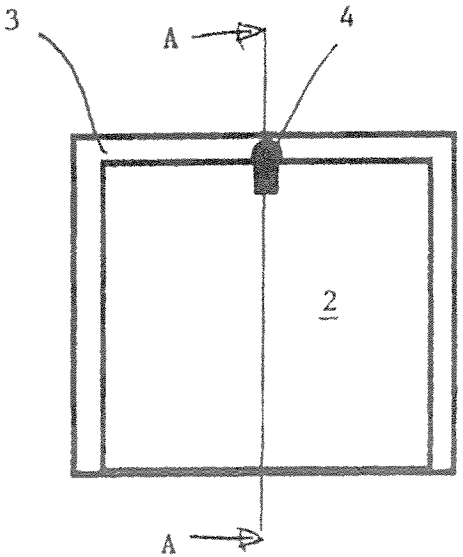
FIG. 2 shows the same device, seen from directly on top.

FIG. 3 and its detail in FIG. 4 show, as a cross-section of FIG. 2, how the cover component 2 is formed of several layers on top of each other, which are folded into this position and locked, with the aid of the securing means 4 shown by way of example, to the reinforcing component 3 at the edge. In this, case, the exemplary securing is performed by an arrow-shaped locking part attached to the securing component 4 pressing into a passage in the edge reinforcement and remaining there by the force of friction. A number of ways and means of securing for performing securing like that shown are known in various technical connections.

The more detailed construction of the device according to the invention can be clearly seen in FIGS. 5 and 6, which show the manner in which the device according to the invention is opened, for example, for play.

As stated above, the cover 2 of the device 1 is formed of several parts 21, 22 and 23 folded on top of each other. FIG. 5 shows how the parts are begun to be opened for use. Starting at the left, the first to be opened is first cover part 21, at the edge of which the securing means 4 is located. Second cover part 22 is then opened and after it third cover part 23. In this particular embodiment, the next part to be opened is the box's front wall 24, to both sides of which are attached to side walls 25, which are inside the box structure 1 in the closed position.

It can be seen most easily from the drawings in FIG. 6 that the cover parts 21-23 are in fact formed of three parts. 'Half-width' additional side parts 21'-23'; 21"-23" are folded laterally from both sides on top of the 'full-width' central part 21-23. As FIG. 6 clearly shows, the side parts 21'-23'; 21"-23" can be essentially vertical, in which case a channel 27 is formed, along which the small articles can be easily slid into the box, or else the side parts too can be spread to form essentially horizontal additional parts.

Reference number 26 is used to mark an example of a connector, by means of which the parts can be secured to each other, in order to make a sturdier structure.

A special feature of the method and device according to the invention is that, in addition to providing a suitable storage box for small articles, for example, building blocks, a play base is also created. A landscape, or play base, on which there is some environment with patterns suitable for games, can be printed on the surface of any device whatever according to the invention.

In addition, when the box structure itself is open, as shown in the right-hand drawing in FIG. 6, the internal parts of the box are uncovered to form an additional accessory for games. It is also possible to envisage that the patterns of the internal parts of the box can be interchangeable with others, thus increasing the usefulness of the device. If desired, pocket-like parts can be located on the inner or outer side or sides of the box, for storing different background boards and pictures. The surfaces of the openable, essentially board-like parts can be equipped with suitable protrusions, grooves, or similar, to the blocks of known building-block systems can be easily attached to them, or an attachment method designed for this arrangement can be used.

The device according to the invention is easy and cheap to manufacture. The size of the device can be as desired, or versions of different sizes can be made. In its simplest form, the manufacturing material is cardboard, but a plastic-based material too is durable and economical to manufacture.

The above description is of only one alternative shape of model. In terms of the invention, it is of no consequence whether the device is an elongated or wide model. The dimensioning can be made as desired according to the intended use.

In use, for example, building blocks stored in the box can be poured out onto the spread base, which can be used as a play base, which can be equipped with a suitable attachment structure for specific building blocks, and from which they can be easily poured back into the box after play. On the other hand, if the small articles are spread outside the area of the base, the device according to the invention will also act like a dust shovel, for gathering the small articles back into it.

The invention claimed is:

1. A box-shaped device (1) for gathering small articles such as building blocks, and comprising a cover (2), formed of at least two cover parts (21, 22) folded on top of each other and which can be opened, characterized in that the cover parts (21, 22) are attached to a front wall (24A) of the box so that the cover (2) can be spread with the front wall (24A) and upstanding, slidable side wall parts (25A, 25B), while preserving the box shape closed at upstanding first side, back and second side walls (24B, 24C and 24D), whereby in use the-cover parts (21, 22), front wall (24A) and side wall parts (25) are-spread to gather small articles in the direction of base (5), wherein the side wall parts remain upstanding when the cover parts, front wall, and side wall parts are spread, and wherein the side-wall parts slide parallel to and are slidably folding with respect to the first and second side walls (24B and 24D).

2. Device according to claim 1, characterized in that, on both sides of the said cover parts (21, 22) there are also additional first, second, third, fourth, fifth and sixth side parts (21'-23'; 21"-23") that can be folded upwards to extend a channel outwardly from the spread side wall parts (25).

3. Device according to claim 1, characterized in that there are at least three (21-23) cover parts that can be folded on top of each other.

4. Device according to claim 1, characterized in that there is a reinforcement part (3) connected to a top of the first side, back and second side walls (24B, 24C and 24D) in the state with the cover parts (21-23) folded.

5. Device according to claim 2, characterized in that the additional first, second, third, fourth, fifth and sixth side parts (21'-23'; 21"-23") folding outwards on the same side are secured to each other by a connector (26).

6. Device according to claim 1, characterized in that the cover parts (21, 22) are folded with respect to each other, in such a way that a folding joint is formed on alternating sides of the parts.

* * * * *